US005408700A

United States Patent [19]

Reuben et al.

[11] Patent Number: 5,408,700

[45] Date of Patent: Apr. 25, 1995

[54] THIN DOWN-FILL INNER LINING FABRIC AND METHOD OF MANUFACTURE

[75] Inventors: Ronnie Reuben; Brian Shea, both of Montreal, Canada

[73] Assignee: Fabco Trading Corp., Montreal, Canada

[21] Appl. No.: 206,711

[22] Filed: Mar. 7, 1994

[51] Int. Cl.[6] ..... A41D 27/02

[52] U.S. Cl. ..... 2/97; 2/69; 2/69.5; 2/85; 2/108; 2/243.1; 428/68; 428/71; 428/72; 428/76; 428/102; 428/220; 112/402

[58] Field of Search ..... 428/68, 71, 76, 72, 428/74, 102, 6; 2/97, 85, 243.1, 108, 267, 69, 69.5; 223/47; 112/402, 439, 440

[56] References Cited

U.S. PATENT DOCUMENTS

| | | | |
|---|---|---|---|
| 1,421,131 | 6/1922 | Abrams | 2/92 |
| 1,569,955 | 1/1926 | Falter | 428/102 |
| 3,034,133 | 5/1962 | Eilenberg | 2/97 |
| 3,541,620 | 11/1970 | Chapus | 5/343 |
| 4,514,455 | 4/1985 | Hwang | 428/198 |
| 4,535,017 | 8/1985 | Kuckein et al. | 428/77 |

FOREIGN PATENT DOCUMENTS

| | | | |
|---|---|---|---|
| 13572 | 5/1928 | Australia | 2/97 |
| 914443 | 10/1946 | France | 2/97 |

*Primary Examiner*—Nasser Ahmad

[57] ABSTRACT

An inner lining fabric of reduced thickness and having a down-fill composition for use as an inner lining in an article of apparel and a method of making the inner lining fabric is disclosed. A patterned envelope is formed and defines a pouch in which down or a down composition is inserted and distributed substantially evenly within the envelope. The envelope is then compressed in portions thereof and stitch seams are formed to define a quilt pattern of closely spaced stitch lines to reduce the loft of the down-fill composition by at least twice the normal loft thereof. This procedure is repeated over the entire envelope whereby the inner lining fabric has at least half the thickness of the normal loft of the down-fill composition. The inner lining fabric may have portions thereof with quilting defining surface areas of different portions to vary the thermal insulating value of different portions of the inner lining.

3 Claims, 3 Drawing Sheets

THIN DOWN-FILL INNER LINING FABRIC AND METHOD OF MANUFACTURE

TECHNICAL FIELD

The present invention relates to a method of making an inner lining fabric having a down-fill composition wherein the composition is compressed to reduce the loft of the down-fill by at least twice the normal loft of the down-fill, and an article of apparel in which such an inner lining of reduced thickness is secured to.

BACKGROUND ART

It is well known in the art that down or down compositions provide excellent thermal insulating value for the reason that the down is very fluffy and traps air which provides excellent insulation. However, because down or compositions thereof is very fluffy, when used as an inner lining for articles of clothing it provides a very puffy appearance. The thicker the fluff in the inner lining, the more insulating value is achieved and the article of clothing is puffier. This has a disadvantage in that the article of clothing becomes very large and disproportionate to the person wearing the article of clothing. For this reason down is utilized in only certain articles of apparel and not others where its insulating value may be desirable.

Because of the above existing problems, other insulating materials are used as inner linings, such as synthetic fibers. However, synthetic fibers cannot replace the excellent thermal insulation properties of down which is a natural product. Also, down is not a polluting agent when released in the environment as are resinous fiber materials.

Another problem with down-fill lining is that the down can be displaced within the lining and congregate in certain portions thereof where it then provides increased insulation while in other portions of the lining the insulating value is reduced. A still further disadvantage of using down-fill interlining, wherein the interlining has a body covering portion as well as arm portions secured thereto, is that the padding or insulation in the armpit region of the inner lining doubles in thickness due to the fact that when the article of clothing is worn the arm extends against the body, thus providing double thickness insulation under the armpit. This makes it very uncomfortable to the wearer and restricts arm movement to some degree.

SUMMARY OF INVENTION

It is a feature of the present invention to provide an improved inner lining formed with down-fill or down-fill compositions and which substantially overcomes the above-mentioned disadvantages of the prior art.

Another feature of the present invention is to provide an inner lining having a down-fill or down-fill composition disposed within a pouch forming the inner lining and wherein the composition is substantially evenly distributed throughout the pouch and retained therein in a compressed form whereby the loft of the down-fill composition is reduced by at least twice the normal loft thereof to produce an insulating lining of reduced thickness.

Another feature of the present invention is to provide a method of making an inner lining fabric having a down-fill composition and wherein the loft of the down-fill composition is reduced by at least twice the normal loft thereof.

A still further feature of the present invention is to provide an inner lining fabric having a down-fill composition and wherein the fabric has a quilt stitching throughout the surface area thereof and wherein the surface area of the quilt patterns is no greater than 1 square inch whereby the loft of the down-fill composition is reduced by at least twice the normal loft thereof and wherein the thermal insulating value of the composition is not reduced by more than 20 percent.

It is another feature of the present invention to provide a down-fill inner lining having a body covering portion and arm portions secured thereto and wherein a cut-out area is provided in the armpit section of the inner lining to devoid it of thermal insulation.

According to the above features, from a broad aspect, the present invention provides a method of making an inner lining fabric having a down-fill composition. The method comprises making a patterned envelope from two opposed fabric layers to form a pouch. A predetermined quantity of down-fill composition is placed in the pouch through a seam opening to obtain a substantially predetermined thermal insulating value for the envelope. The seam opening is then stitched and the envelope is placed on a backing surface with the down-fill composition substantially evenly spread therein. The envelope is compressed with the down-fill material in a predetermined area and quilt seams are stitched in this area to interconnect the opposed fabric layers thereby to retain the down-fill composition compressed to reduce the loft of the down-fill composition by at least twice the normal loft thereof. This procedure is repeated throughout the entire surface area of the patterned envelope to produce a patterned envelope forming an inner lining fabric having at least half the thickness of the normal loft of the down-fill composition.

According a still further broad aspect of the present invention there is provided an article of apparel having a down-fill composition inner lining fabric. The inner lining fabric is secured over at least portions of an inner surface area of the article of apparel. The inner lining fabric has an outer fabric layer and an inner fabric layer forming a patterned lining pouch. A down-fill composition is provided inside the pouch and is distributed substantially evenly therein. A quilt stitched pattern interconnects the outer and inner lining fabrics and is defined by closely spaced patterns of stitched lines arranged to compress the loft of the down-fill composition by at least twice the normal loft thereof to produce an inner lining fabric having at least half the thickness of the normal loft of the down-fill composition. The inner lining also has an outer peripheral seam thereabout.

According to a still further broad aspect of the present invention there is provided a thermally insulated article of apparel which comprises a body portion and arm portions secured thereto. The body portion and arm portions have an inner fabric layer and an outer fabric layer forming patterned pouches. A down-fill composition is provided inside the pouches and distributed substantially evenly therein. The pouch also have an outer peripheral seam. A quilt stitched pattern interconnects the outer and inner lining fabric to maintain the down-fill composition substantially evenly distributed throughout the body portion and arm portions. A cut-out area is defined in an armpit region of the article of apparel between the body portion and arm portions.

BRIEF DESCRIPTION OF DRAWINGS

A preferred embodiment of the present invention will now be described with reference to the examples thereof illustrated in the accompanying drawings in which.

DESCRIPTION OF PREFERRED EMBODIMENTS

Figure 1:
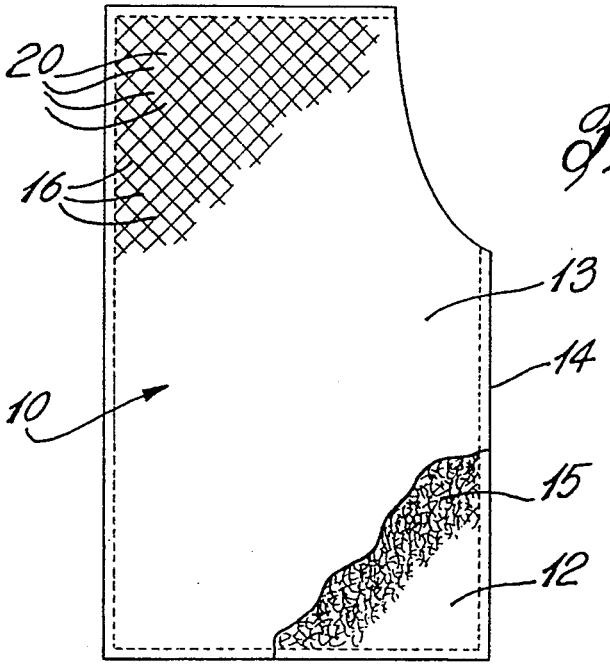
FIG. 1 is a plan view showing a down-fill composition patterned envelope formed in accordance with the present invention.
Figure 5A:
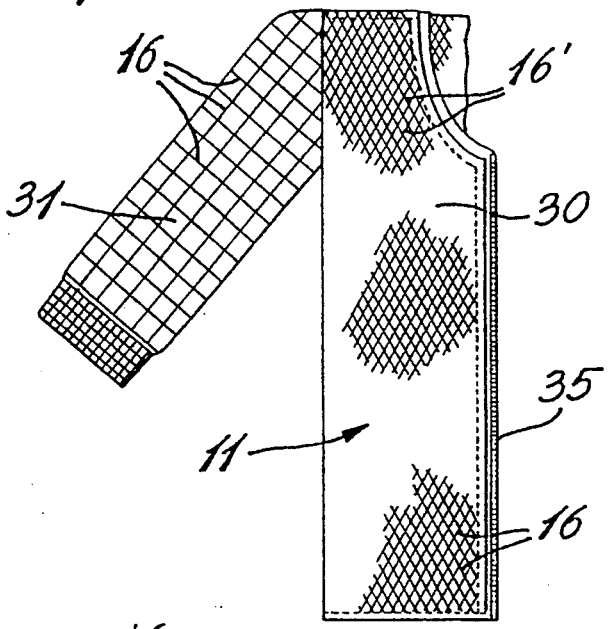
FIG. 5A is a fragmented plan view showing an inner lining fabric having a down-fill composition and constructed in accordance with the present invention wherein the body portion and arm portions of the inner lining have different thermal insulating values achieved by quilting patterns of different sizes.
Figure 4D:
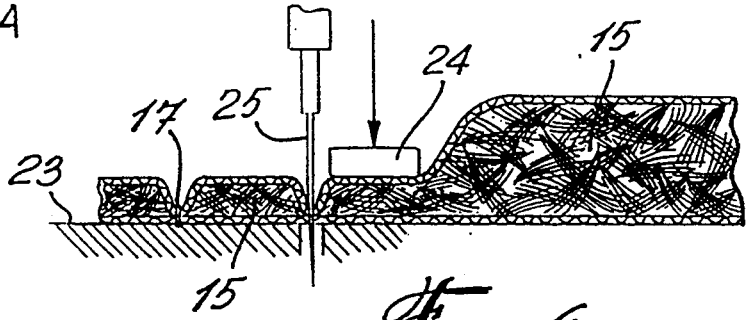
Figure 6:
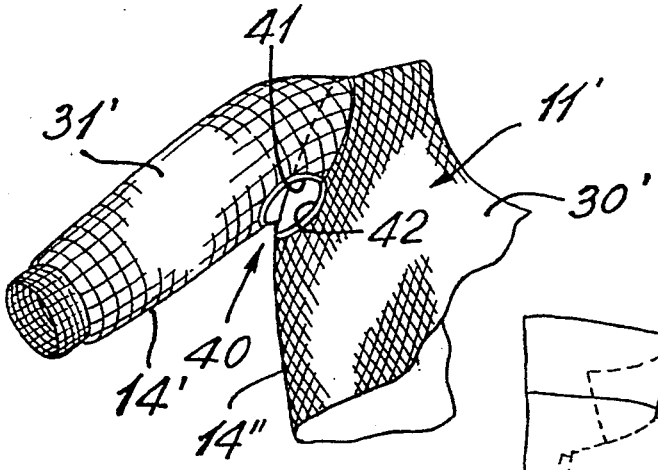
FIG. 6 is a fragmented perspective view showing a thermally insulated article of apparel constructed in accordance with the present invention and wherein a cut-out area is provided in the armpit region of the article of apparel.
Figure 7:
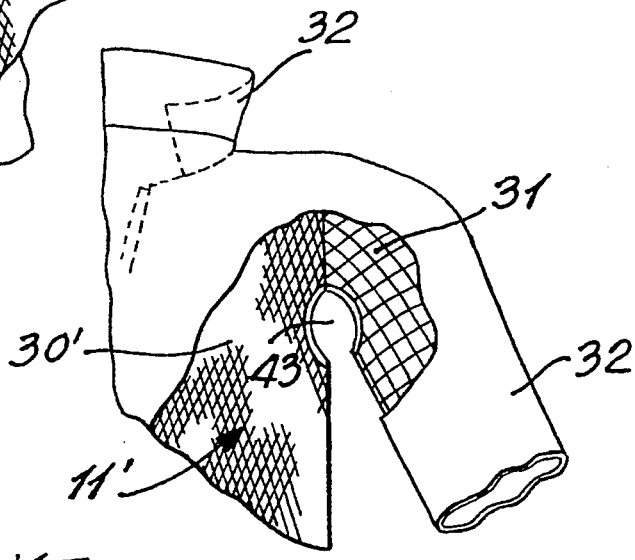
FIG. 7 is a fragmented perspective view illustrating the thermally insulated article of apparel having an outer fabric defining a specific article of apparel secured to the thermally insulated lining exposing the cut-out area in the armpit region.

Referring now to the drawings, and more particularly to FIG. 1, there is shown a pattern lining pouch 10 constructed in accordance with the present invention to constitute an inner lining fabric or thermally insulated article of apparel 11, as shown in FIGS. 5A, 6 and 7. The patterned inner lining pouch 10 is formed by an inner fabric layer of material 12 and an outer fabric layer of material 13 which are connected together by stitching along the outer peripheral edge 14 thereof. The fabric materials 12 and 13 may be any suitable material depending on the use of the pouch 10. The patterned lining fabric pouch 10 is filled with a predetermined quantity of down-fill material 15 or compositions thereof which is distributed substantially evenly therein by manipulation. A quilt stitch pattern 16 interconnects the outer and inner lining fabric 13 and 12 and maintains the down-fill composition 15 substantially evenly distributed and compressed within the pouch.

As shown in FIG. 1, the quilt stitching pattern 16 is defined by closely spaced patterns of stitch lines 17 arranged to compress the loft of the down-fill composition 15 to produce the thermally insulated article of apparel 11 which has a thickness that is at least half the thickness of the normal loft of the down-fill composition.

Figure 2:
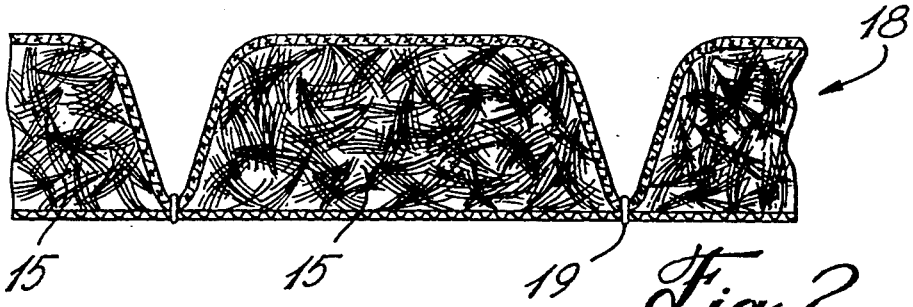
Fig. 2 (PRIOR ART)
FIG. 2 is a section view showing a down-fill insulating lining formed in accordance with the prior art.

FIG. 2 shows a cross-section of a down-fill insulating material 18 of the type well known in the prior art. Because the down-fill 15 is known to have superior thermally insulating properties when expanded, due to the fact that air is trapped within the down, it has been common in the trade not to compress the down but rather to package it loose so that it assumes its normal loft. For this reason, any stitching 19 is spaced apart large distances to prevent compressing the down-fill material 15. As previously discussed, this bulky inner lining limits the use thereof and provides other inconveniences in articles of apparel, and for this reason its application has some restraints.

Figure 3:
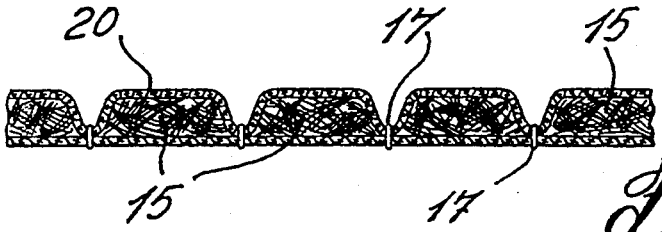
FIG. 3 is a similar view of the lining of FIG. 2, but formed in accordance with the present invention showing the substantial reduction in thickness in the inner lining.

We have found that by quilting this type of material with closely spaced stitch lines, as shown in FIG. 1, the thickness of the inner insulating lining can be greatly reduced to at least twice the thickness of the prior art down-fill insulating linings. By compressing the down-fill material 15, as shown in FIG. 3, to at least twice the normal loft, the thermal insulating value thereof is reduced in the range of 10 to 20 percent. However, such reduction has been found acceptable due to the great reduction in thickness of the lining and due to the fact that the lining has many more applications in articles of apparel, such as in rainwear, all types of winter coats, etc. As shown in FIG. 3, the quilt stitched pattern 16 is very closely spaced and defines quilt patterns having surface areas 20 which are not more than 1 square inch.

Figure 4A:
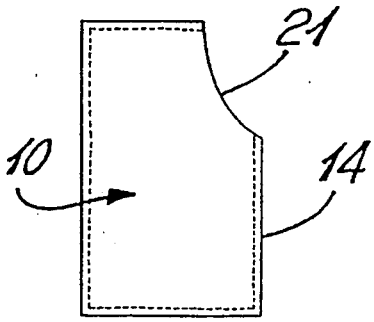
FIGS. 4A to 4D are sequential schematics illustrating the manner in which the down-fill composition inner lining fabric of the present invention is made.
Figure 4B:
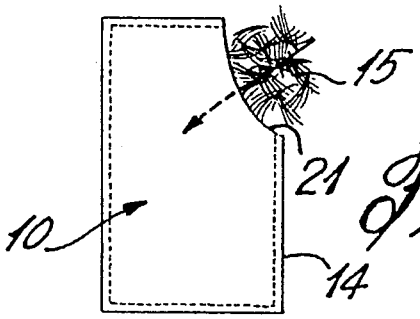
Figure 4C:
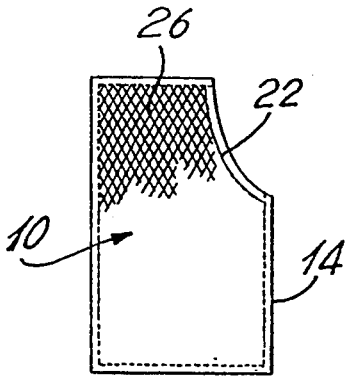

Referring now additionally to FIGS. 4A to 4D, there will be described the method of making such an insulating inner lining fabric. As previously described, patterned envelopes 10 are formed by sewing inner and outer patterned fabric layers together. However, in doing so a seam opening 21 is provided in the outer peripheral edge 14, as shown in FIG. 4A. The down-fill composition material 15 is then introduced in the seam opening 21, as shown in FIG. 4B, by suitable means such as by a hose (not shown) having an air pressure therein. Once this material is introduced in the pouch the seam opening 21 is stitched, as illustrated by stitch lines 22 in FIG. 4C. The down is then distributed substantially evenly by manipulating the pouch. The spreading of the composition is achieved by the operator who moves the pouch around and feels by hand the material when substantially evenly distributed therein. The pouch 10 is then placed on a backing surface 23 where means, such as a pressure element 24, which may also be the hand of a person, applies pressure in a predetermined area of the pouch. At the same time a stitching needle 25 is brought down on the pouch to form stitch lines 17. One of the fabric layers 12 or 13 is premarked with chalk lines 26 (see FIG. 4C) to indicate the location of these stitch lines 17.

It is pointed out that the thickness of the insulating inner lining or article of apparel 11 is predetermined by the quantity of down-fill material placed within the pouches 10 and the spacing of the stitch lines 17. Hence the surface areas 20 of the quilt stitch pattern 16 is dependent on these parameters. It has been found that the down-fill composition should be compressed to at least twice the normal loft of the down or composition thereof, as illustrated in FIGS. 2 and 3, in order to achieve a substantial reduction in the thickness of the lining and adequate thermal insulation.

Referring now to FIG. 5A, there is shown the thermally insulating article of apparel 11 wherein the body portion 30 thereof and arm portions 31 are provided with quilt stitch patterns 16' and 16'' defining surface areas 20 of the patterns of different sizes. Accordingly, the body portion or arm portions are of different thickness. They may also have a lesser quantity of down-fill composition per square inch area therein. The inner lining or article of apparel 11 may therefore have different thermal insulating values in portions thereof. Also the different thicknesses of this material provides ease of securement to an outer fabric layer, such as the outer fabric layer 32 illustrated in FIG. 7. It also provides more freedom of movement and a less bulky appearance to an article of apparel. Another advantage is that the thermally insulated article of apparel 11 may by itself constitute an article of apparel with the outer layer thereof having a decorative appearance provided by the type and color of material utilized or the patterns 16', 16'' may be of different designs as well as sizes.

Figure 5B:
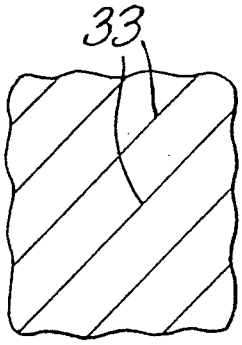
FIGS. 5B and 5C illustrate quilt patterns of different shapes.
Figure 5C:
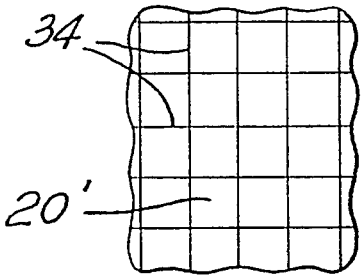

FIG. 5B illustrates a different quilt pattern which is constituted by a plurality of closely spaced parallel stitch seams 33 extending throughout the body portion 30 and arm portions 31. FIG. 5C illustrates a still further quilt stitch pattern 34 defined by transverse stitch lines forming square surface areas 20' which are no greater than approximately 1 square inch and distributed over the entire surface area of the article of apparel 11. As shown in FIG. 5A, the quilt stitch pattern 16' is of diamond shape whereas the pattern 16'' in the arm portion is of square shape. A fastener 35 may also be secured along a securing outer edge of the thermally insulating article of apparel 11 to secure same to an outer finishing fabric layer 32, such as shown in FIG. 7.

Referring now to FIG. 6, there is shown a thermally insulated article of apparel 11' which is formed of pattern pouch sections having a down-fill material therein but which may not necessarily be compressed in accordance with the present invention. However, by providing closely spaced stitched patterns, as previously described in accordance with the present invention, the advantages of thinness and variable thermal insulation in various portions of the article are achieved. As herein shown, the improvement resides in that a cut-out area 40 is provided in an armpit region of the article of apparel 11' between the body portion 30' and the arm portions 31'. As herein shown, the cut-out area 40 is comprised of a shallow U-shape cut-out section 41 formed in the peripheral seam 14' of the arm portion 31' in the armpit region. A further shallow U-shape cut-out section 42 is also formed in the peripheral seam 14'' of the body portion 30' adjacent the cut-out section 41 of the arm portion 31'. Accordingly, and as shown in FIG. 7, when the thermal insulating article of apparel 11' is worn there is no thermally insulating material or insulation in the armpit region 43, and this provides better movement to the wearer. It also eliminates discomfort provided by having a double layer of thermal insulation in that area which is bulky and which also provides increased insulation in an area where the sweat glands of the wearer are more susceptible to activation by increased heat.

It is within the ambit of the present invention to cover any obvious modifications of the preferred embodiment of the present invention described herein, provided such modifications fall within the scope of the appended claims.

We claim:

1. A thermally insulated apparel comprising a down-fill composition inner lining fabric, said inner lining fabric being attached over at least portions of an inner surface area of said article of apparel, said inner lining fabric having an outer fabric layer and an inner fabric layer forming a patterned lining pouch, a down-fill composition inside said pouch and distributed substantially evenly therein, a cross-stitched pattern interconnecting said outer and inner lining fabrics and defined by closely spaced patterns of stitched lines, said stitched lines being arranged to maintain the loft of said down-fill composition compressed by at least twice the normal loft of said composition to produce an inner lining fabric having at least half the thickness of the normal loft of said down-fill composition, said cross-stitched pattern defining a plurality of small squares of not more than 1 square inch in surface area over the entire surface area of said pouch, said inner lining fabric being further formed with portions thereof having different thermal insulating values with a substantially uniformly distributed down-fill composition in said pattern lining pouch, said portions having cross-stitched pattern forms of different size surface areas but not greater than 1 square inch, said different thermal insulating values varying in the range of from 10 to 20%, said inner lining having an outer peripheral seam.

2. An article of apparel as claimed in claim 1 wherein said cross-stitched pattern defines a plurality of closely spaced parallel stitched seams over the entire surface area of said pouch.

3. An article of apparel as claimed in claim 1 wherein said inner lining defines a body insulating portion and arm portions connected thereto, said body and arm portions defining an armpit region, an opening in said armpit region and extending into both said body and arm portions of said inner lining whereby said armpit region is void of said down-fill composition inner lining fabric.

* * * * *